US005208407A

United States Patent [19]

Stover

[11] Patent Number: 5,208,407

[45] Date of Patent: May 4, 1993

[54] GUN SIGHT MOUNTING SYSTEM FOR SHOTGUN

[75] Inventor: Gerold E. Stover, Lapeer, Mich.

[73] Assignee: Williams Gunsight & Outfitters, Davison, Mich.

[21] Appl. No.: 687,992

[22] Filed: Apr. 19, 1991

[51] Int. Cl.[5] ..... F41G 1/10; F41G 1/42

[52] U.S. Cl. ..... 42/102; 33/233

[58] Field of Search ..... 42/100, 102, 40; 33/233

[56] References Cited

U.S. PATENT DOCUMENTS

| | | | |
|---|---|---|---|
| 370,344 | 9/1887 | Long | 33/233 |
| 1,142,665 | 6/1915 | Burton | 42/100 |
| 1,496,852 | 6/1924 | Hussey | 42/100 |
| 3,726,037 | 4/1973 | Wolff | 42/102 |
| 3,834,035 | 9/1974 | Merrill | 42/100 |
| 4,008,536 | 2/1977 | Adams | 42/102 |
| 4,899,479 | 2/1990 | Sanders | 42/102 |
| 4,941,277 | 7/1990 | Lawlor | 42/100 |

FOREIGN PATENT DOCUMENTS

| | | | |
|---|---|---|---|
| 1135799 | 5/1957 | France | 42/100 |
| 2308077 | 11/1976 | France | 42/100 |

*Primary Examiner*—Stephen M. Johnson

*Attorney, Agent, or Firm*—Harness, Dickey & Pierce

[57] ABSTRACT

A gun sight mounting assembly for a firearm having a vent rib on its barrel. The assembly includes a mounting base which has a sight member attached thereto. The mounting base has a recess which is adapted to tightly engage a width of a vent rib. A securement member is provided which may be drawn toward the mounting base for clampingly securing the vent rib therebetween for securing the gun sight to a vent rib.

4 Claims, 3 Drawing Sheets

GUN SIGHT MOUNTING SYSTEM FOR SHOTGUN

BACKGROUND OF THE INVENTION

The present invention relates to a gun sight mounting system for a shotgun or other firearm having a vent rib on its barrel. More particularly, the present invention relates to a gun sight which may be readily mounted to a shotgun barrel having a vent rib for providing adjustable sighting capabilities for shotgun barrels for firing of slugs and other projectiles accurately from a standard shotgun barrel having a vent rib.

In the past, shotguns have primarily been designed for wing shooting and the like wherein moving targets must readily be identified and sighted for a moving shot. Because in such situations there is often not enough time to precisely sight in the target, shotguns have been equipped generally with flat plane type sights such that the shooter may look directly down the barrel for sighting in and leading the target for an accurate shot.

In recent years, shotgun barrels having vent ribs have increasingly been successfully utilized in shotguns to provide advantages in sighting and hitting a target with a shotgun. Such vent ribs have been advantageous in that they provide a flat clean sight plane for the shooter to look down and quickly superimpose the barrel onto the target. Also, vent ribs act to better dissipate heat which causes visual distortion after several shots have been fired from the shotgun.

While shotguns having vent ribs have been highly advantageous in sports such as trap and skeet shooting, and general wing shooting, such sights do not readily lend themselves to rifle-like accuracy which would be useful in hunting big game and the like. Because, in the past big game and other more stationary targets were not generally hunted with shotguns, the vent rib sighting system was generally sufficient for any type of shot loads and the like which were to be used on various types of targets where a shot pattern is utilized. However, in recent years due increasing population densities and to the range associated with rifles, several states have created special "shotgun only" area for hunting game such as white-tailed deer, for instance. Thus, increasingly, shotguns are being used in hunting of big game in areas where traditionally rifles and such had been used. With the advent of such laws and changes in hunting conditions it has been increasingly a goal in the art to provide better barrels and sights for shotguns, to provide increased accuracy for slug type projectiles such as are used with hunting of big game.

One of the primary remedies for the accuracy requirements of these new sports has been the use of special slug barrels which may be readily replaced on some pump and automatic type shotguns in use today. While such slug barrels have provided increased accuracies, in that they are designed for shooting mainly projectile loads and also have standard rifle type sights on them, such barrels are somewhat cost prohibitive in that the entire barrel is needed to provide such accuracy in a shotgun.

Thus, in recent years, several sighting systems have been proposed for use as attachments for shotguns which do not require the replacement of the wing shooting barrel with a slug barrel or the like. Such sights range from telescopic sights, which are attached to the receiver of the gun, to some sights which have been proposed to be attached to vent rib barrels of shotguns. In general, these sights have not received favorable use in that the sights attached to the receivers generally were expensive and do not produce premium accuracy whereas some of the sights used in the vent rib applications have been relatively cheaply constructed and have not provided good solid mounting to the vent rib which would withstand jolts from repeated firing. Thus, even with these add-on type sights, the shotgun did not obtain its maximum accuracy.

Therefore, it has been a goal in the art to provide a superior gun sight mounting system for mounting of gun sights to vent rib barrels thereby reducing the need for a separate slug barrel and without loosing accuracy due to repeated firing of the shotguns.

SUMMARY OF THE INVENTION

In accordance with these goals and objectives the present invention provides a gun sight mounting system for a firearm having a vent rib on its barrel. The mounting system includes a mounting base having a gun sight member attached thereto. The mounting base includes a recess means for engaging the top and sides of the vent rib. A means is provided for clampingly engaging the vent rib from the bottom of the vent rib for securing the sight to the vent rib of the shotgun barrel by clamping engagement of the vent rib.

It is an object of the present invention to provide a secure sturdy mounting means which will not shake loose or otherwise change once a sight is mounted on a vent rib and is sighted in. It is a further object of the present invention to provide a gun sight mounting system which is inexpensive and readily mountable on vent ribs commonly found on shotguns.

DETAILED DESCRIPTION OF THE PREFERRED EMBODIMENT

Figure 1:
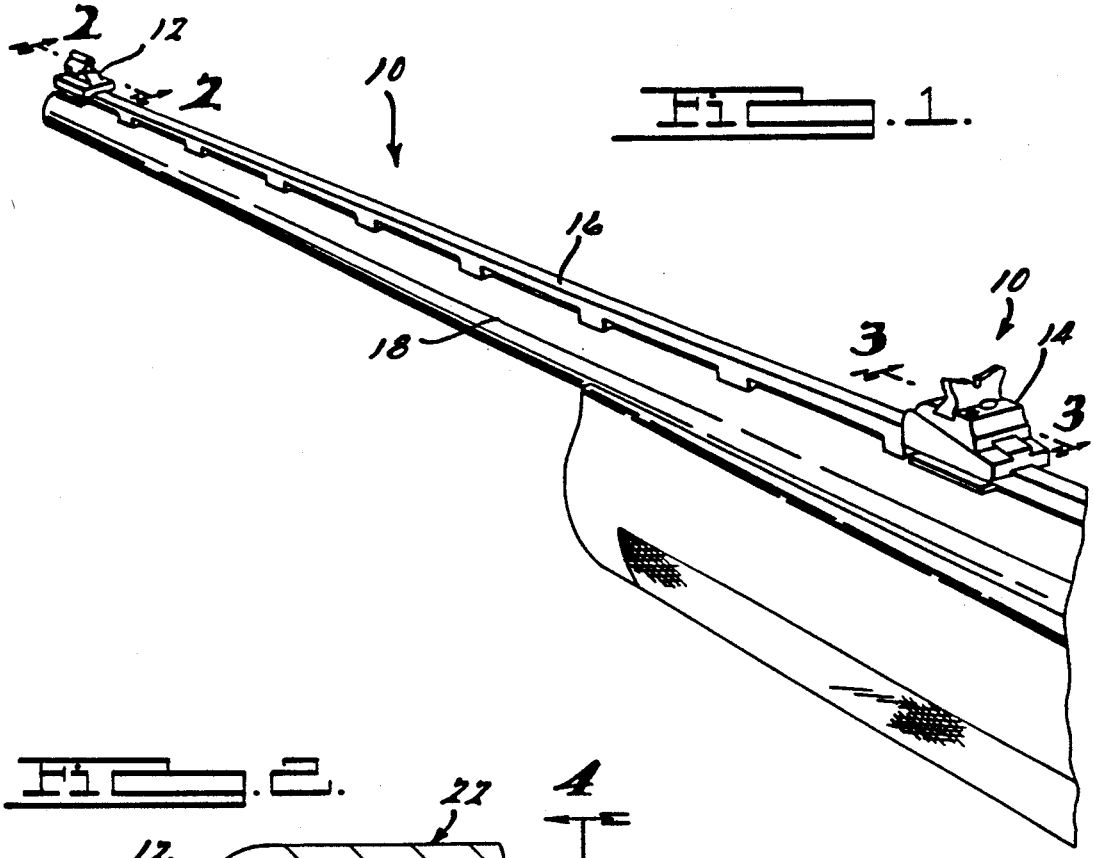
FIG. 1 is a perspective view partially broken away of a shotgun barrel with a vent rib having the gun sight mounting system of the present invention attached thereto.

In accordance with the present invention there is provided a gun sight mounting system, generally shown at 10. The mounting system 10 of the present invention may be utilized on either the front sight 12 or the rear sight 14 for mounting the sights to a vent rib 16 of shotgun barrel 18.

Figure 2:
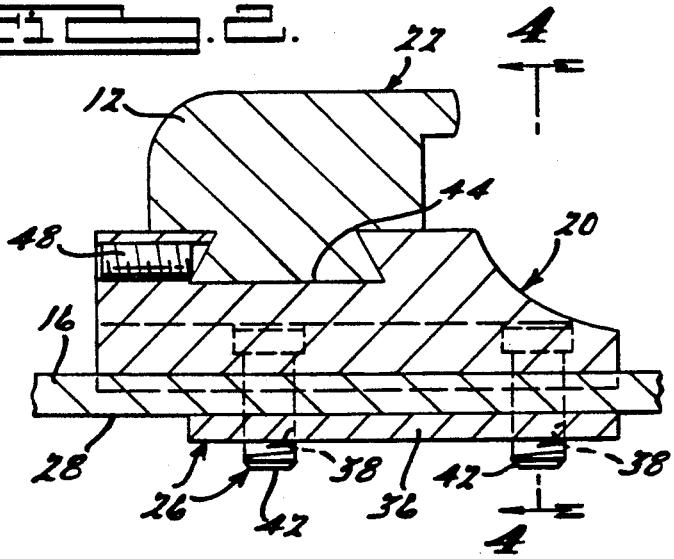
FIG. 2 is a sectional view of the front sight of the present invention taken along line 2—2 of FIG. 1.
Figure 4:
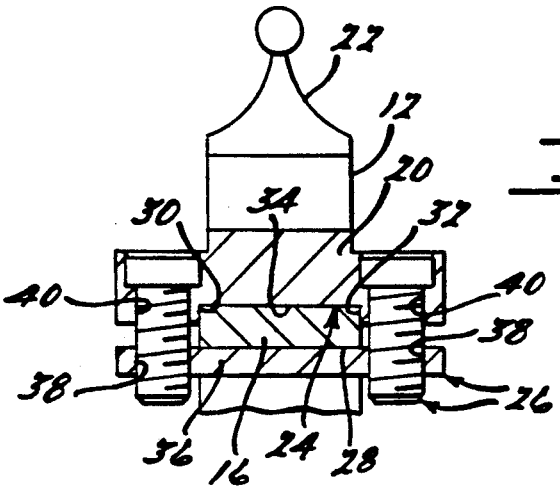
FIG. 4 is a sectional view taken along line 4—4 of FIG. 2.

Referring now to FIGS. 2 and 4, the gun sight mounting system of the present invention generally includes a mounting base 20 with a sight member 22 attached thereto. The mounting base includes a recess means (shown best in FIG. 4 at 24). The recess means 24 engages the top and sides of the vent rib 16 for securely cradling of the vent rib 16 therein to prevent any side-to-side movement of the mounting base. The present invention includes a means, generally indicated at 26, for clampingly engaging the vent rib 16 from the bottom 28 of the vent rib 16 for securing the mounting base 20 to the vent rib 16 by clamping the vent 16 between the recess means 24 and the means 26 for clampingly engaging the vent rib 16.

In a preferred embodiment the recess means 24 is provided by an open sided recess formed by walls 30, 32 and 34. Thus, the recess formed by the parallel side walls 30 and 32 and top wall 34 is adapted to tightly engage the vent rib portion 16 on a particular type shotgun barrel such that the sight will not move from side to side during firing of the shotgun.

The means 26 in a first embodiment includes a plate member 36 which is a flat planar member. Plate member 36 is adapted to clampingly secure the underside 28 of the rib member 16. The plate member 36 includes threaded bores 38. The base member 20 includes counter set bores 40 therein which are adapted to provide insertion of threaded fastener 42 for clampingly engaging the vent rib 16 between the plate 36 and the recess formed by walls 30, 32 and 34.

Figure 8:
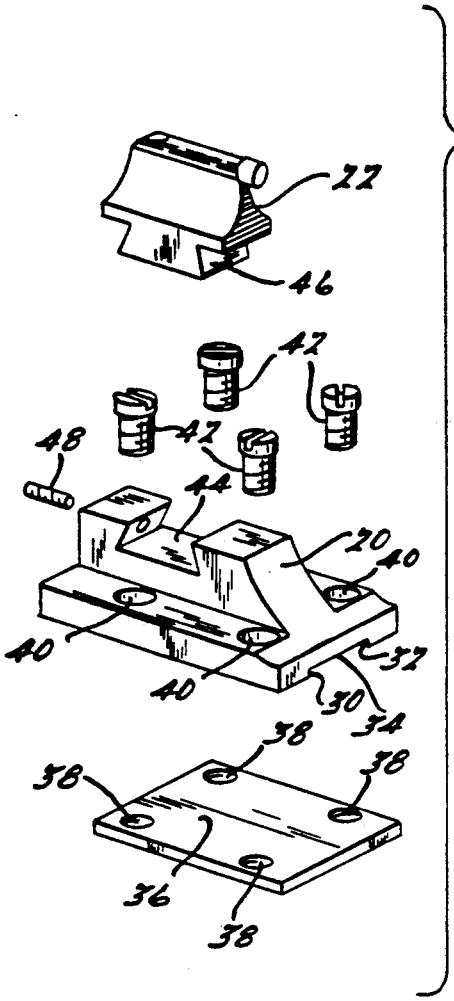
FIG. 8 is an exploded perspective view showing a front sight of the present invention.

Referring to FIGS. 2, 4 and 8, the front sight of the present invention is also advantageous in that a dove tail slot 44 is formed in the base 20. The sight blade 22 includes a mating dove tail protrusion 46 which transversely fits in the slot and allows transverse movement of the sight for side-to-side adjustment of the front sight. Thus, the sight blade 22 is transversely slidable in the dove tail channel 44. A set screw assembly 48 is provided for locking the sight blade 22 in position by frictionally engaging the base 20 of the sight blade.

Figure 3:
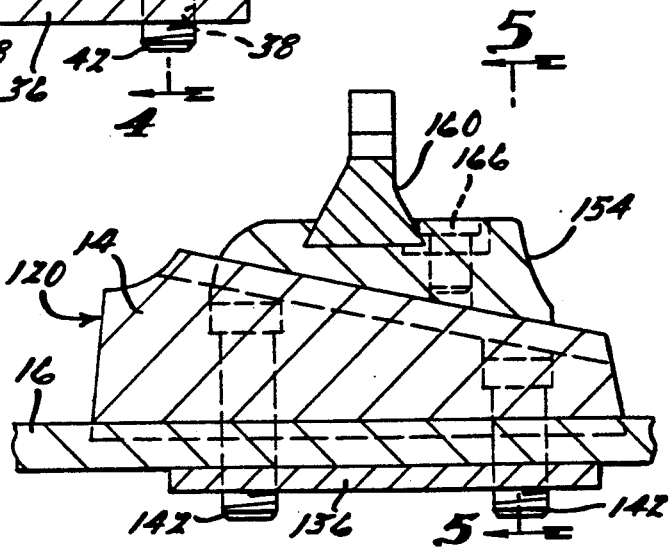
FIG. 3 is a sectional view of the rear sight of the sight system of the present invention taken along line 3—3 of FIG. 1.
Figure 5:
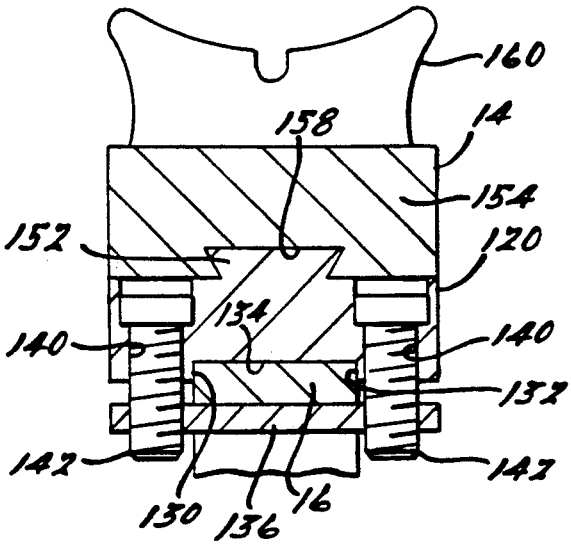
FIG. 5 is a sectional view taken along line 5—5 of FIG. 3.
Figure 9:
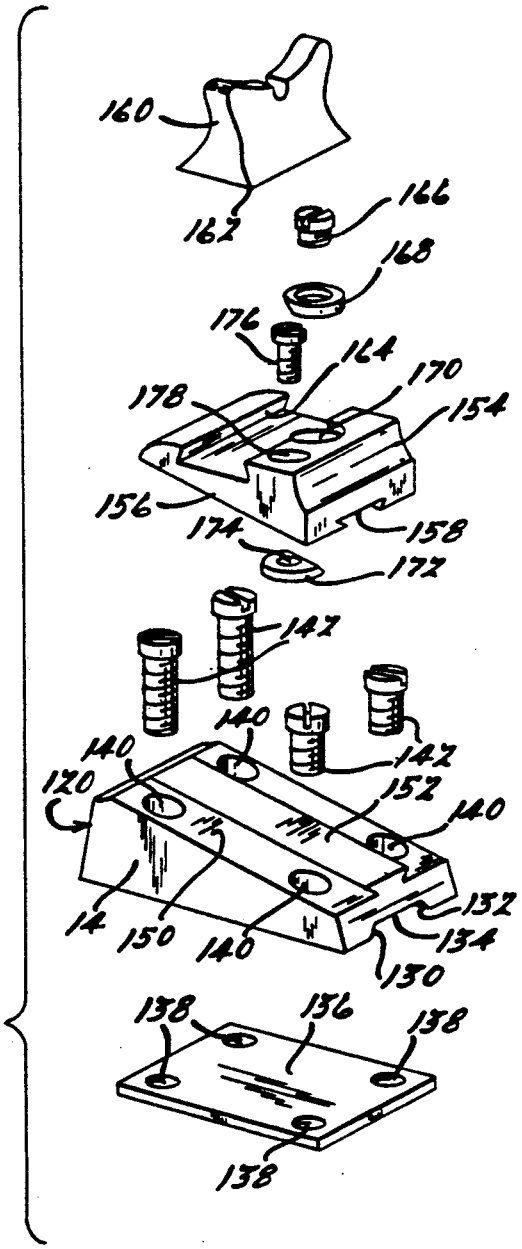
FIG. 9 is an exploded perspective view of a rear sight of the mounting system of the present invention.

Referring now to FIGS. 3, 5 and 9, a rear sight member utilizing the mounting system of the present invention is shown at 14. In FIGS. 3, 5 and 9, like elements are designated by like members differing by amounts of one hundred. Thus, the rear sight includes a base 120 with bores 140. Fasteners 142 are inserted through the bores 140 and engaged threaded bores 138 of the securement plate 136 for clampingly securing the vent rib 16 between the base 120 and the plate 136. Again, the surfaces 130, 134 and 132 are designed to engage the vent rib about the sides and top thereof.

The rear sight adjustment system is a conventional design which provides for adjustment for windage and elevation in the rear sight. While such an elevation and windage adjustment system is known in the art, a brief description will be given herein. The base 120 includes a ramped surface 150 which includes a dove tail projection 152. A sight base 154 is provided which includes a reverse slanted surface 156. Surface 156 is shaped to be slidably coupled on the surface 150 of mounting base 120. The sight base 154 includes a dove tail groove 158 which is adapted to slidingly engage the dove tail projection 152. The sight base 154 is slidable along the surface 150 for adjustment of elevation and is lockable at a particular position by way of locking washer 172 which has a threaded bore 174 by which fastener screw 176 may clampingly engage the dove tail protrusion 152 for securement of the member 154. The set screw 176 is insertable through the counter sunk bore 178 in the sight face 154 for accomplishing locking. A sight blade 160 which includes dove tail base 162 is slidable transversely into the dove tailed groove 164 in the slight base 154. The set screw 166 passes through the lock washer 168 for locking the sight blade 160 in the desired windage position by securement of the screw 166 into the bore 170.

Figure 6:
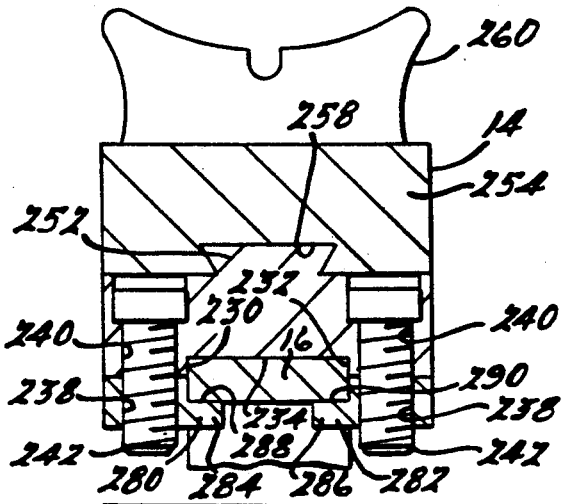
FIG. 6 is a sectional view similar to FIG. 5 showing an alternate embodiment of the mounting system of the present invention which includes an L-shaped securement member for mounting of the system on a thicker type vent rib.
Figure 7:
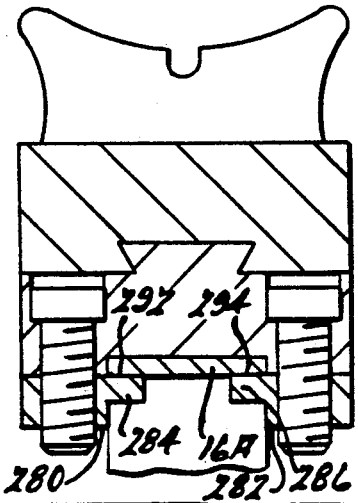
FIG. 7 is a sectional view similar to FIG. 6 showing the L-shaped securement member reverse for mounting of the sight system of the present invention on a thinner type vent rib.

Referring now to FIGS. 6 and 7, there is shown an alternate embodiment of the mounting system of the present invention which is useful for adapting to shotguns having various thickness of vent ribs. Again, like members differing in amounts of one hundred refer to like elements in the embodiment set forth in FIGS. 6 and 7. As will be readily appreciated, the entire difference in FIGS. 6 and 7 and the previous embodiment is that a pair of laterally spaced elongate securement members 280 and 282 provide for securement of the vent rib in this embodiment. Securement members 280 and 282 are L-shaped and include transversely extending leg portions 284 and 286 which clamping secure a portion of the underside of the vent rib 16. As shown in FIG. 6 the L-shaped member 280 and 282 may be used to engage a standard width vent rib 16 by way of the surfaces 288 and 290. The L-shaped members also provide a certain amount of adaptability to utilize the present invention with a thinner vent rib, such as shown at 16A. By turning the elongated L-shaped members over such as shown in FIG. 7, the bottom surfaces 292 and 294 are utilized to clampingly engage the thinner vent rib 16A. Thus, when the members are set forth in a first configuration, such as shown at FIG. 6, a wider vent rib may be clamped and when a narrow vent rib is encountered the members may be turned over essentially to clampingly engage a narrower vent rib which could not be accommodated with the securement members 280 and 282 in the first position.

In a preferred embodiment the mounting base and associated clamping parts are made from a sturdy metal material which will hold its shape in the recess area even during repeated fire.

While the above description constitutes the preferred embodiments of the present invention, it is to be appreciated that the invention is susceptible to modification, variation and change without departing from the proper scope and fair meaning of the accompanying claims.

What is claimed is:

1. A gun sight mounting assembly for a firearm having a vent rib on its barrel, said vent rib including a top surface, a bottom and a pair of sides comprising:

a mounting base having a sight member attached thereto, said mounting base including a recess means for tightly engaging the top and sides of the vent rib such that the sight will not move from side to side during firing of the shotgun;

a means for clampingly engaging the vent rib from the bottom of the vent rib for securing the mounting base to the vent rib of the firearm barrel;

wherein said means for clampingly engaging said vent rib further comprises a pair of L-shaped securement members which are operable to clamp a thin vent rib in a first position and which when reversed are adapted to engage a thicker vent rib in a secured position.

2. The gun sight mounting assembly for a firearm having a vent rib on its barrel comprising:

a mounting base having a means for attachment of a sight member thereto, said mounting base including surfaces forming a recess adapted for tightly engaging a width of said vent rib and resting on a top surface of said vent rib;

a pair of elongate securement members which are L-shaped in cross section, said securement members being positionable along a width of the vent rib in a first position for engaging a thin rib member and which when positioned in a second position may be utilized for securement of a thicker vent rib; and a means for drawing said pair of securement members toward said mounting base for securing of said mounting base to said vent rib.

3. A gun sight mounting assembly, for a firearm having a vent rib on its barrel, said vent rib having a width comprising:

a mounting base having a means for attachment of a sight member, said mounting base including surfaces forming a recess therein adapted for tightly engaging the width of said vent rib;

a pair of elongate securement members which are L-shaped in cross-section;

a means for drawing said securement members towards said mounting base for securing of said mounting base to said vent rib wherein said securement members are positionable in a first position underneath the vent rib for engaging a thin vent rib member and positionable in a second position for securement of a thicker vent rib.

4. The gun sight mounting assembly of claim 3 wherein said sight member further comprises a front sight blade and includes a means for transversely moving the sight blade from side to side.

* * * * *